US005749421A

United States Patent [19]

Johansson et al.

[11] Patent Number: 5,749,421

[45] Date of Patent: May 12, 1998

[54] PNEUMATIC IMPACT BREAKER

[75] Inventors: Ingemar Sven Johansson, Haninge; Ake Lennart Nilsson, Enskede, both of Sweden

[73] Assignee: Atlas Copco Berema AB, Nacka, Sweden

[21] Appl. No.: 700,527

[22] PCT Filed: Feb. 28, 1995

[86] PCT No.: PCT/SE95/00210

§ 371 Date: Dec. 6, 1996

§ 102(e) Date: Dec. 6, 1996

[87] PCT Pub. No.: WO95/23050

PCT Pub. Date: Aug. 31, 1995

[30] Foreign Application Priority Data

Feb. 28, 1994 [SE] Sweden ..... 9400685

[51] Int. Cl.[6] ..... B25D 17/04

[52] U.S. Cl. ..... 173/162.2; 173/128; 173/169; 173/170

[58] Field of Search ..... 173/168, 169, 173/170, 15, 16, 17, 206, 162.1, 162.2, 114, 128

[56] References Cited

U.S. PATENT DOCUMENTS

| | | | |
|---|---|---|---|
| 2,926,637 | 3/1960 | Spurlin | 173/170 |
| 2,984,210 | 5/1961 | Fuehrer | 173/170 |
| 3,275,089 | 9/1966 | Kaiser et al. | 173/170 |
| 3,939,925 | 2/1976 | Danielson | 173/170 |
| 4,576,241 | 3/1986 | Emonet | 173/170 |
| 4,718,502 | 1/1988 | Garcez | 173/171 |
| 5,273,120 | 12/1993 | Chang | 173/162.2 |
| 5,524,715 | 6/1996 | Kimberlin et al. | 173/169 |

FOREIGN PATENT DOCUMENTS

WO 93/11912 6/1993 WIPO .

*Primary Examiner*—Scott A. Smith

*Attorney, Agent, or Firm*—Frishauf, Holtz, Goodman, Langer & Chick

[57] ABSTRACT

A pneumatic impact breaker includes a housing provided at a rear end thereof with at least one handle, a longitudinal cylinder bore formed in the housing, and a hammer piston reciprocally guided in the cylinder bore. A socket is formed in a front portion of the housing for receiving a rear impact receiving end of a working implement. An air distributing valve is located in a rear portion of the cylinder bore and arranged to direct motive pressure air alternatingly to opposite ends of the hammer piston to make the hammer piston reciprocate in the cylinder bore. And a cylinder head forms a closure for the cylinder bore as well as an axial support for the air distributing valve. The cylinder head at least partly extends into the rear portion of the cylinder bore, the housing is formed at the rear end thereof with two parallel wall portions both extending rearwardly beyond the cylinder head, and the at least one handle extends in between the two parallel wall portions. In addition, a wedge bolt is mounted between the two parallel wall portions and extends perpendicularly to the two parallel wall portions as well as to the cylinder bore to form an axial lock for the cylinder head and a mounting position for the at least one handle.

19 Claims, 3 Drawing Sheets

PNEUMATIC IMPACT BREAKER

This invention relates to a pneumatic impact breaker of the type comprising a housing which at its rear end is provided with one or two handles and which is formed with a longitudinal cylinder bore, a hammer piston reciprocably guided in the cylinder bore, a front portion of the housing which includes a socket means for receiving the rear impact receiving end of a working implement, an air distributing valve located in the rear part of the cylinder bore and arranged to direct motive pressure air alternatingly to the opposite ends of the hammer pistons to make the latter reciprocate in the cylinder bore, and a rear cylinder head forming a closure of the cylinder bore as well as an axial support for the air distributing valve.

BACKGROUND OF THE INVENTION

Pneumatic impact breakers of the above type provide an effective breaking by a high impact energy but generate at the same time external vibrations and internal blows which have a detrimental influence on the operator as well as on the mechanical parts. By using vibration damped handles it has been aimed to improve safety conditions for the operator, and at the same time the breaker itself has to have a very rugged design to withstand the risk of damage at operation. This normally means an increased weight of the breaker as a result of heavy steel components and also a need for strong side bolts or space demanding screw joints to keep the parts together. Examples thereof are shown in the following patent publications: U.S. Pat. Nos. 3,446,294, 4,303,133, and U.S. Pat. No. 4,673,042. The latter two patents also disclose an exchange of steel components for parts of a plastic material so as to bring down the total weight of the breaker, and reduce vibrations and noise. Also, in British patent GB 2,018,904 it is understood that conventional screw joints are used to keep the parts together, and a specific valve arrangement is disclosed.

OBJECT OF THE INVENTION

The object of the invention is to redesign the rear part of pneumatic breaker such that heavy side bolts and screw joints are eliminated, the weight and size of the cylinder head is substantially reduced, more components of plastic material are used for keeping down the weight and manufacturing costs, and ergonomically improved vibration damped handles are fitted to the rear part of the machine. These purposes are achieved by the invention as it is recited in the following claims.

BRIEF DESCRIPTION OF THE DRAWINGS

Preferred embodiments of the invention are described below with reference to the accompanying drawings.

In the drawings.

DETAILED DESCRIPTION

Figure 1A:
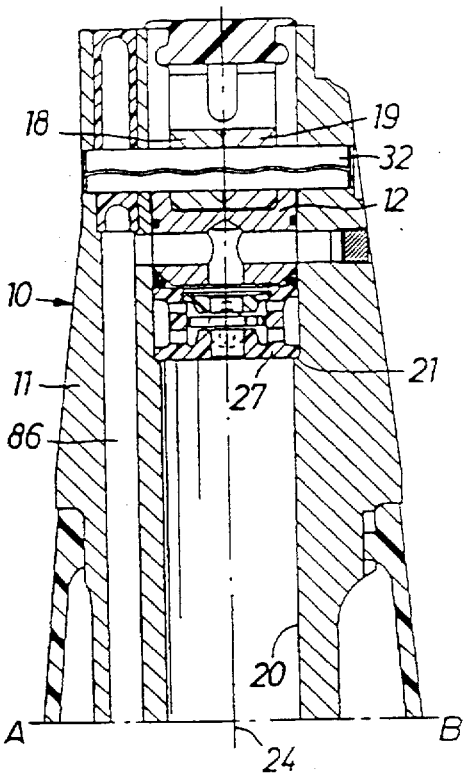
FIG. 1A and 1B show longitudinal sections, divided by a transverse line A-B, through the pneumatic breaker according to the invention.
Figure 1B:
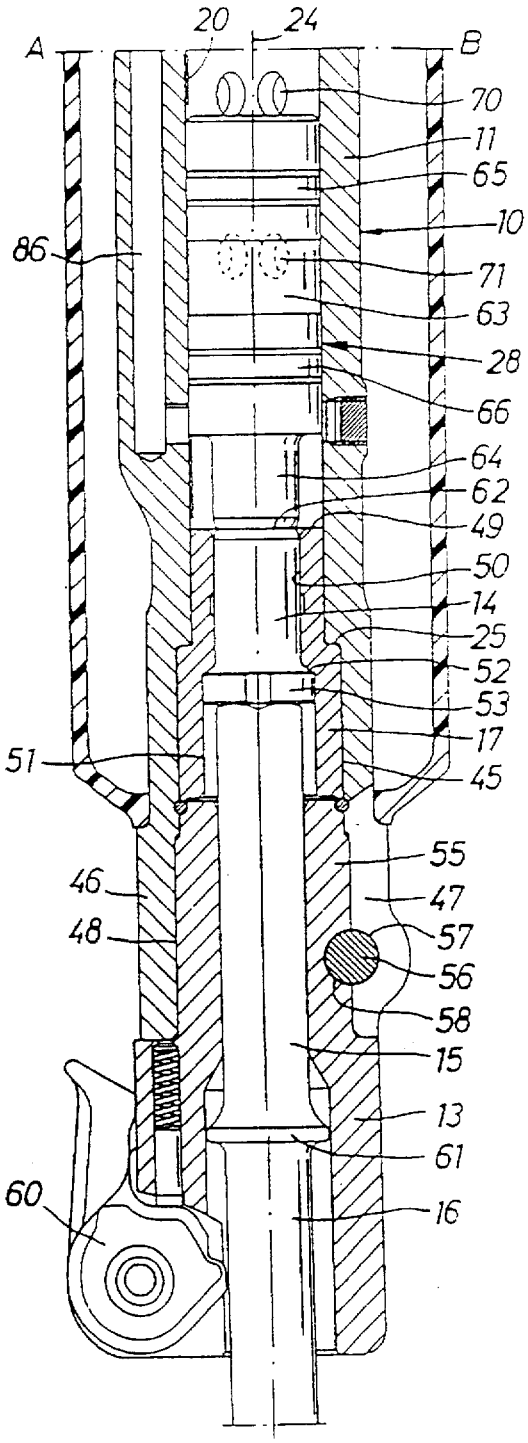
Figure 4:
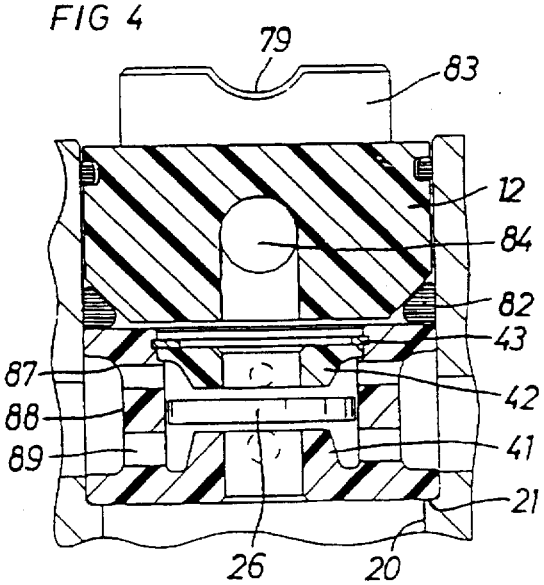
FIG. 4 shows on a larger scale a fractional view of FIG. 3.

The impact breaker 10 shown in FIGS. 1A, 1B comprises an elongate housing 11 with a cylinder bore 20 and provided with a cylinder head 12, handles 18, 19, and a front portion 13. These parts are interconnected and symmetrically oriented relative to the longitudinal axis 24 of the cylinder bore 20. The cylinder bore 20 is extended rearwardly from an annular shoulder 21 through an enlarged bore 23. The cylinder bore 20 is also extended forwardly from an inner annular shoulder 25 through a forward bore 45. In front of the bore 45 the housing 11 is formed with a clamping portion 46 including an axial slot 47. The clamping portion 46 defines a further enlarged bore 48 which extends coaxially with the bore 45 and the cylinder bore 20.

In the bore 45 there is received a sleeve shaped intermediate member 17 which has an outer shoulder for abutting cooperation with the annular shoulder 25 and which extends sealingly into the cylinder bore 20. The intermediate member 17 has an annular end surface 49 which faces the cylinder bore 20. The intermediate member 17 is a part of the front section of the breaker housing 11 and serves as a guide sleeve for the impact receiving parts of the tool. The intermediate member 17 has a central coaxial first bore 50 and an enlarged coaxial second bore 51 separated from the first bore 50 by an annular forwardly facing shoulder 52. The front portion 13 of the housing is a separate part which is formed with a tubular neck 55 to be inserted in the enlarged bore 48 of the clamping portion 46, thereby being axially located by the intermediate member 17 which defines the axial position of the front portion 13 relative to the housing 11 via the annular shoulder 25.

A clamping bolt 56 extends transversely through a bore 57 in the clamping portion 46 and engages a tangential groove 58 in the neck portion 55 to lock positively the latter axially relative to the housig 11. By means of a nut (not shown) the clamping bolt 56 locks frictionally the neck 55 to the clamping portion 46 such that the front portion 13 and the intermediate member 17 are rigidly secured to the housing 11.

In the bore 50 in the intermediate member 17 there is sealingly guided an impact transferring anvil 14. The anvil 14 is formed with an impact receiving end surface 62 facing the cylinder bore 20 and an annular flange 53 which is guided in the enlarged second bore 51. The anvil 14 is rewardly displaceable by the neck portion 15 of the working implement 16, and the interengagement of the flange 53 and the annular shoulder 52 defines the rear working position of the anvil 14 relative to the housing 11. See FIG. 1B. In the working position of the anvil 14, the rear impact receiving end surfaces 62 is located substantially in level with or slightly below the rear end shoulder 49 of the intermediate member 17. In a conventional way, the front portion 13 carries a releasable working implement retainer 60 which is engagable with the collar 61 of the working implement 16 while allowing a limited axial movement of the latter with the neck 15 guided in the neck portion 55 of the front portion 13. In its forwardmost position, the working implement 16 is blocked against further movement by the retainer 16 engaging the collar 61, which means that the anvil 14 remains in its extended position in which it abuts against the neck portion 55 of the front portion 13. The anvil 14 and the neck 15 forms the impact transferring means of the working implement 16.

Figure 2:
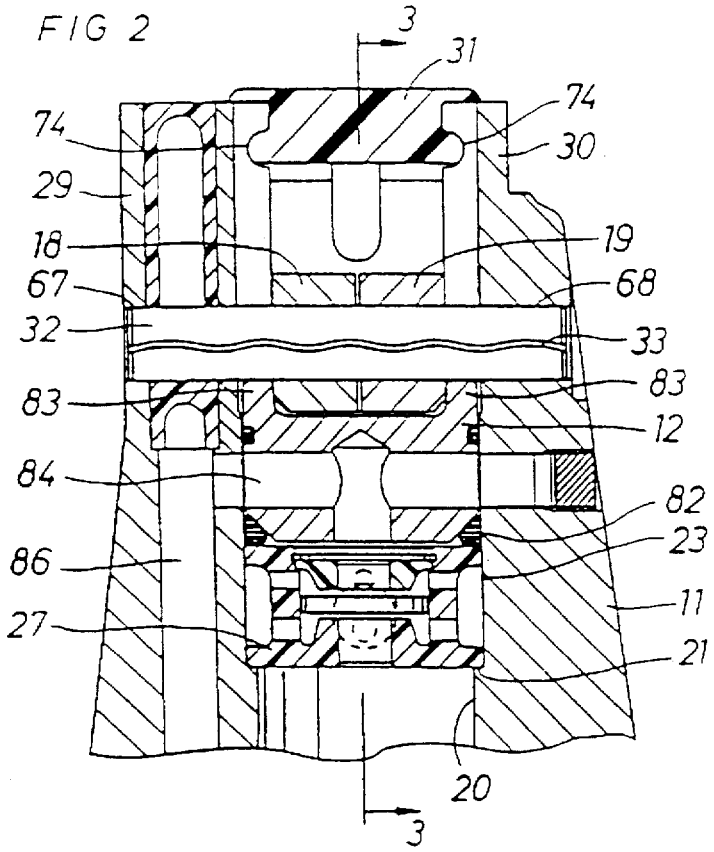
FIG. 2 shows on a larger scale a longitudinal section of the rear part of the breaker according to FIG. 1A.
Figure 3:
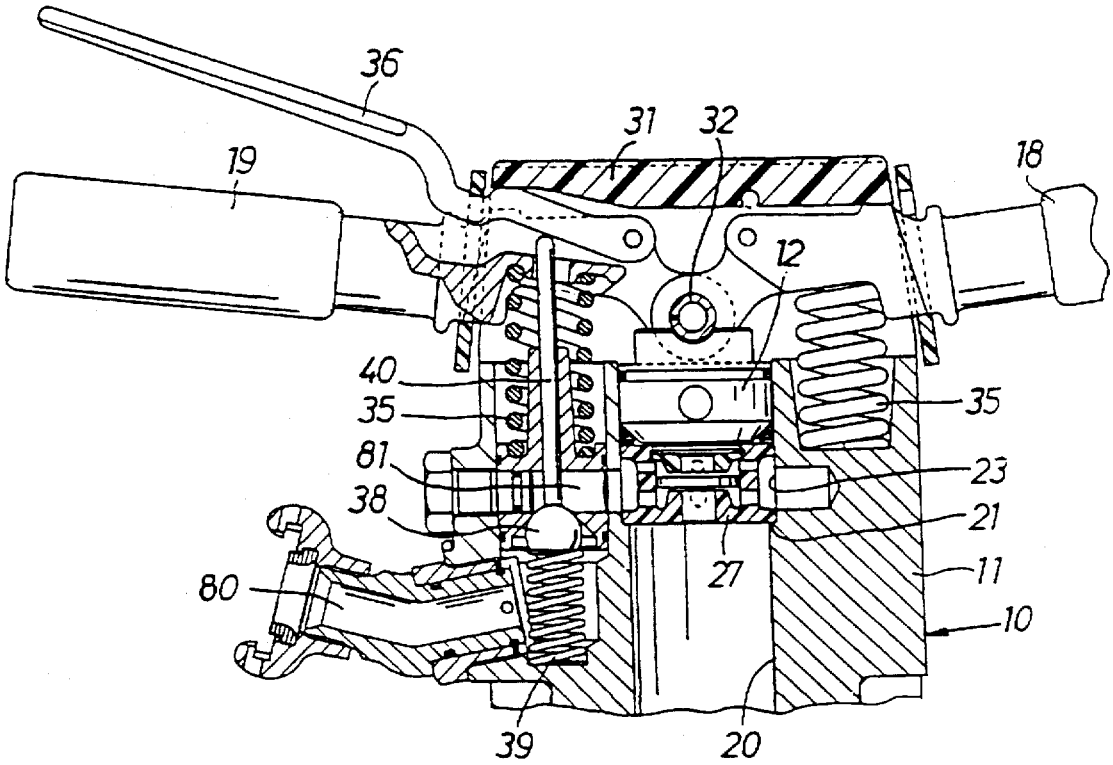
FIG. 3 shows a section on a somewhat smaller scale along line 3—3 i FIG. 2.

At its rear end, the housing 11 is formed with two side walls 29, 30, FIG. 2, which extend rearwardly beyond the cylinder head 12 and the central portions of the handles 18, 19. In opposite coaxial bores 67, 68 in the side walls 29, 30 there is inserted a wedge bolt 32 which comprises a cylindrical steel tube having an axially extending zigzag shaped slot 33 for obtaining radial compressability. Thanks to the zigzag shaped slot 33, the wedge bolt 32 gets a smoother outer surface without any straight cutting edges which could damage the bores 67, 68 at mounting. The wedge bolt 32 forms a mounting pivot for the central parts of the handles 18, 19, FIG. 3, thereby connecting the handles 18, 19 to the housing 11. Vibration damping pretensioned springs 35 are located between the housing 11 and each of the handles 18, 19 to bias the handles toward a rear end cover 31. This end cover 31 is formed of a plastic material and is secured in opposite grooves 74 in the side walls 29, 30.

Inside the cover 31, the handle 19 supports a pivot lever 36 which by means of a push rod 40 is arranged to control an air inlet valve 38. The latter is biassed by a spring 39 toward closed position. By manipulating the lever 36, thereby activating the inlet valve 38, a connection between a pressure air inlet 80 and an inlet passage 81 in the housing 11 and the rear bore 23 of the cylinder bore 20 is controlled.

Resting on the axial shoulder 21 in the enlarged bore 23, there is inserted a valve housing 27 of a distributing valve, FIG. 2, 4,. The cylinder head 12 comprises a plug of metal or a plastic material which is introduced into the enlarged bore 23 and abuts and locks axially the valve housing 27 via a seal ring 82. At its rear end the plug 12 is formed with two rearwardly extending heals 83 which are formed with indentations 79 and which are located on both sides of the handles 18, 19. The heals 83 rest against the wedge bolt 83 such that the plug 12 is axially locked in the bore 23. The plug 12 has a radially extending air distributing passage 84 which via a longitudinally extending feed passage 86 in the housing 11 communicates with a front end of the cylinder bore 20. The passage 84 is open toward the valve housing 27 via a central axially extending opening.

The valve housing 27 is formed in a plastic material, preferably acetal plastic (delrin), and comprises a rotationally symmetric and substantially cup-shaped main part having an outer circumferential groove 87 communicating with the air inlet passage 81 in the housing 11. In the valve housing 27, there is shiftably disposed a valve plate 26, also of a plastic material, for alternative cooperation with a forward valve seat 41 which is open to the cylinder bore 20 and a rear valve seat 42 which is open to the radial air passage 84 in the plug 12. The bottom 88 of the circumferential groove 87 is provided with radial openings 89 which are disposed in axially separated rows between which the valve plate 26 is shiftable. The rear valve seat 42, also formed in a plastic material such as acetal plastic, comprises a lid which is inserted in the valve housing 27 and locked by a lock ring 43. See FIG. 2.

Figure 5:
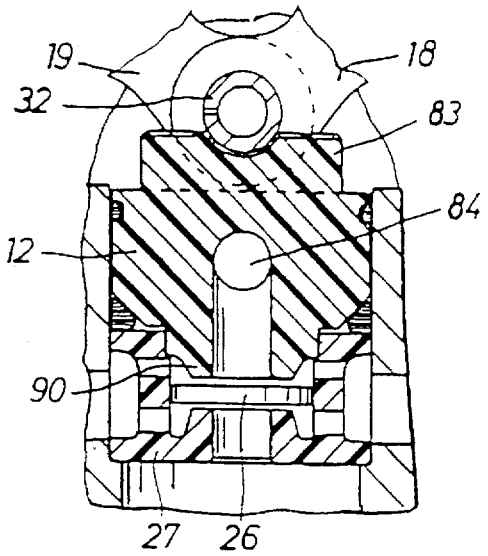
FIG. 5 shows a detail view similar to FIG. 4, but illustrates an alternative embodiment.

In a modified design, shown in FIG. 5, the rear valve seat 42 may be formed in one piece with the cylinder head plug 12 and have the form of a ring portion 90 extending around the central opening communicating with the radial passage 84.

In the cylinder bore 20, between the valve housing 27 and the end surface 49 of the intermediate member 17, there is reciprocably guided a hammer piston 28. The latter is formed with a piston head 63 which comprises a rear end portion 65 and a forward end portion 66 and which are sealingly guided in the cylinder bore 20 and a piston neck 64 which is intended to deliver hammer blows onto the impact receiving surface 62 of the anvil 14.

As an alternative to the above described embodiment, the impact receiving surface may be formed by the rear end surface of the working implement neck 15, which means that the anvil 14 may be omitted.

As the operator applies the impact breaker 10 against the working surface the working implement 16 as well as the anvil 14 are displaced rearwardly to their normal operating positions. (See FIG. 1B.) As the lever 36 is pressed down, pressure air will be supplied to the valve housing 27 from the air inlet 80, through the inlet valve 38 and the passage 81. By cooperating alternatively with the valve seats 41, 42, the valve plate 26 will distribute pressure air to the respective ends of cylinder bore 20, to thereby make the hammer piston 28 reciprocate in the cylinder bore 20 and deliver repetetive hammer blows on the anvil 14. During the reciprocation of the hammer piston 28, the respective parts of the cylinder chamber 20 are vented to the atmosphere through outlet openings 70, 71 located at different axial levels in the housing 11. The outlet openings 70 vent the rear part of the cylinder chamber 20 behind the hammer piston 28, while the openings 71 vent the forward part of the cylinder chamber 20 in front of the hammer piston 28.

Figure 6:
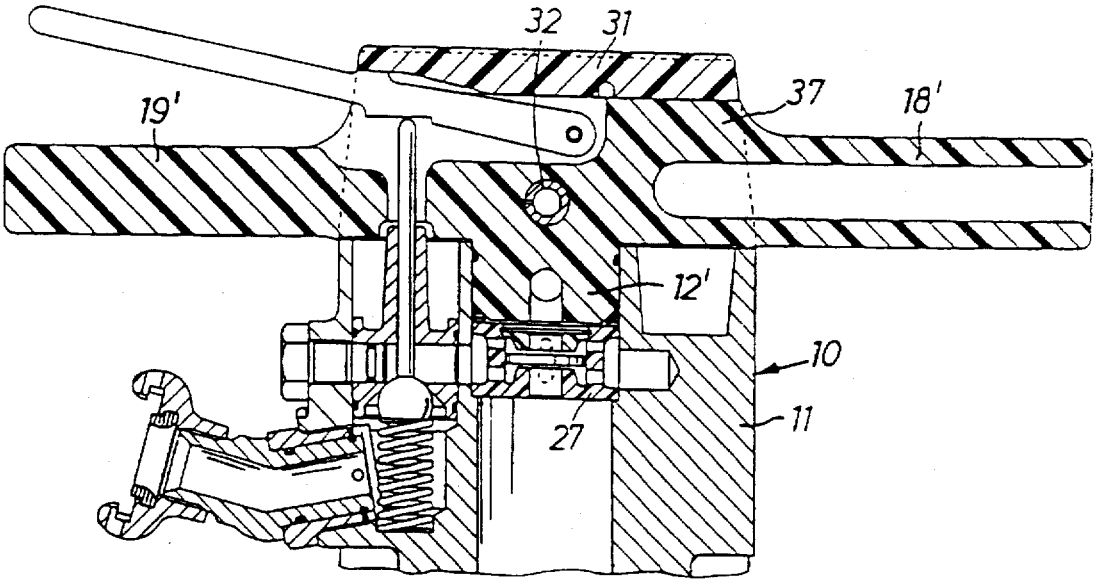
FIG. 6 shows a view similar to FIG. 3, but illustrates an alternative handle design.

In FIG. 6, there is shown a simpler design of the pneumatic impact breaker 10 which comprises a cylinder head 37 formed in a plastic material (for instance polyeurethan ) and formed in one piece with the handles $18^1$, $19^1$ and the plug $12^1$. This cylinder head and handle design may be fitted as a replacement unit by removing the end cover 31 and the wedge bolt 32 and inserting the alternative parts and lock them to the housing 11 by the insertion of the wedge bolt 32.

We claim:

1. A pneumatic impact breaker comprising:

a housing provided at a rear end thereof with at least one handle;

a longitudinal cylinder bore formed in said housing;

a hammer piston reciprocally guided in said cylinder bore;

a socket formed in a front portion of said housing for receiving a rear impact receiving end of a working implement;

an air distributing valve located in a rear portion of said cylinder bore and arranged to direct motive pressure air alternatingly to opposite ends of said hammer piston to make said hammer piston reciprocate in said cylinder bore; and a cylinder head forming a closure for said cylinder bore as well as an axial support for said air distributing valve;

wherein said cylinder head at least partly extends into said rear portion of said cylinder bore;

wherein said housing is formed at said rear end thereof with two parallel wall portions both extending rearwardly beyond said cylinder head;

wherein said at least one handle extends in between said two parallel wall portions; and wherein a wedge bolt is mounted between said two parallel wall portions and extends perpendicularly to said two parallel wall portions as well as to said cylinder bore to form an axial lock for said cylinder head and a mounting member for said at least one handle.

2. The impact breaker according to claim 1, wherein said wedge bolt comprises a tube shaped steel member having a longitudinal, substantially zigzag shaped slot.

3. The impact breaker according to claim 2, wherein said cylinder head comprises a plug sealingly received in said cylinder bore and forming a rear mounting support for said air distributing valve.

4. The impact breaker according to claim 3, wherein said at least one handle comprises two handles which are independently pivotal on said wedge bolt and which are biassed by springs rearwardly into engagement with a cover rigidly mounted at said rear end of said housing between said two parallel wall portions.

5. The impact breaker according to claim 3, wherein said at least one handle comprises two handles, and said two handles and said cylinder head are formed in one piece and secured to said housing by said wedge bolt.

6. The impact breaker according to claim 5, wherein said two handles and said cylinder head are formed of a vibration damping plastic material.

7. The impact breaker according to claim 2, wherein said at least one handle comprises two handles, and said two handles and said cylinder head are formed in one piece and secured to said housing by said wedge bolt.

8. The impact breaker according to claim 7, wherein said two handles and said cylinder head are formed of a vibration damping plastic material.

9. The impact breaker according to claim 1, wherein said cylinder head comprises a plug sealingly received in said cylinder bore and forming a rear mounting support for said air distributing valve.

10. The impact breaker according to claim 9, wherein said at least one handle comprises two handles which are independently pivotal on said wedge bolt and which are biassed by springs rearwardly into engagement with a cover rigidly mounted at said rear end of said housing between said two parallel wall portions.

11. The impact breaker according to claim 9, wherein said at least one handle comprises two handles, and said two handles and said cylinder head are formed in one piece and secured to said housing by said wedge bolt.

12. The impact breaker according to claim 11, wherein said two handles and said cylinder head are formed of a vibration damping plastic material.

13. The impact breaker according to claim 1, wherein said at least one handle comprises two handles which are independently pivotal on said wedge bolt and which are biassed by springs rearwardly into engagement with a cover rigidly mounted at said rear end of said housing between said two parallel wall portions.

14. The impact breaker according to claim 1, wherein said air distributing valve comprises a valve housing with a forward valve seat communicating with said rear portion of said cylinder bore via a communication passage extending in parallel with said cylinder bore, and a substantially flat valve element disposed perpendicularly to a longitudinal axis of said cylinder bore and being axially displaceable between said forward valve seat and a rear valve seat.

15. The impact breaker according to claim 14, wherein said rear valve seat is formed by a protruding ring portion on a plug which extends into said rear portion of said valve housing.

16. The impact breaker according to claim 14, wherein said valve housing is substantially cup-shaped, said forward valve seat is located at a bottom portion of said substantially cup-shaped valve housing, and said rear valve seat is formed as a lid secured by a lock ring.

17. The impact breaker according to claim 1, wherein a clamping sleeve is provided at said front portion of said housing and said clamping sleeve includes an axial slot arranged to receive a rear neck portion of said front portion of said housing in order to lock said rear neck portion to said housing with a laterally located transverse clamp bolt.

18. The impact breaker according to claim 1, wherein said at least one handle comprises two handles, and said two handles and said cylinder head are formed in one piece and secured to said housing by said wedge bolt.

19. The impact breaker according to claim 18, wherein said two handles and said cylinder head are formed of a vibration damping plastic material.

* * * * *